United States Patent [19]

Gabillet

[11] Patent Number: 4,555,791

[45] Date of Patent: Nov. 26, 1985

[54] METHOD AND APPARATUS FOR DETERMINATION OF THE STATE OF AN ALL-OR-NONE MODULATED ALTERNATING SIGNAL IN A PERTURBED ENVIRONMENT

[75] Inventor: Jean-Francois Gabillet, Coye la Foret, France

[73] Assignee: Jeumont-Schneider Corporation, Puteaux, France

[21] Appl. No.: 377,803

[22] Filed: May 13, 1982

[30] Foreign Application Priority Data

May 19, 1981 [FR] France ..... 81 09919

[51] Int. Cl.[4] ..... H04L 27/06

[52] U.S. Cl. ..... 375/58; 375/38; 340/825.74; 307/364

[58] Field of Search ..... 246/20, 125, 218; 455/59, 63, 68, 70, 303; 375/38, 76, 75, 89, 91, 58; 340/825.73, 825.74, 825.75, 825.76, 870.26, 870.27; 329/146, 178; 371/68, 48, 57; 307/355, 362, 364

[56] References Cited

U.S. PATENT DOCUMENTS

| | | | |
|---|---|---|---|
| 1,752,325 | 4/1930 | Branson | 375/58 |
| 1,886,263 | 11/1932 | Ilberg | 375/38 |
| 2,070,418 | 2/1937 | Beverage | 370/30 |
| 2,507,176 | 5/1950 | Posthumus | 375/75 |
| 2,572,074 | 10/1951 | Terry et al. | 340/825.74 |
| 2,602,852 | 7/1952 | Lense et al. | 340/825.74 |
| 3,413,608 | 11/1968 | Benzuly | 340/825.73 |
| 3,571,522 | 3/1971 | Cox | 329/145 |

FOREIGN PATENT DOCUMENTS

| | | |
|---|---|---|
| 2444251 | 3/1976 | Fed. Rep. of Germany . |
| 2302640 | 9/1976 | France . |

*Primary Examiner*—Benedict V. Safourek

*Attorney, Agent, or Firm*—Rines and Rines Shapiro and Shapiro

[57] ABSTRACT

The state of an all-or-none modulated useful signal subjected to a perturbed environment is determined, on reception, through the use of non-modulated reference signals subjected to the same environment. The reference signals have respective frequencies neighboring that of the useful signal and the same initial amplitude so that all of the signals are attenuated in the same manner by environmental perturbations. By comparing against a threshold reference value the differences between the respective amplitudes of the received reference signals and the amplitude of the received useful signal, the "all" and "none" states of the useful signal are accurately determined irrespective of the effect of perturbed environment on the amplitude of the useful signal.

4 Claims, 1 Drawing Figure

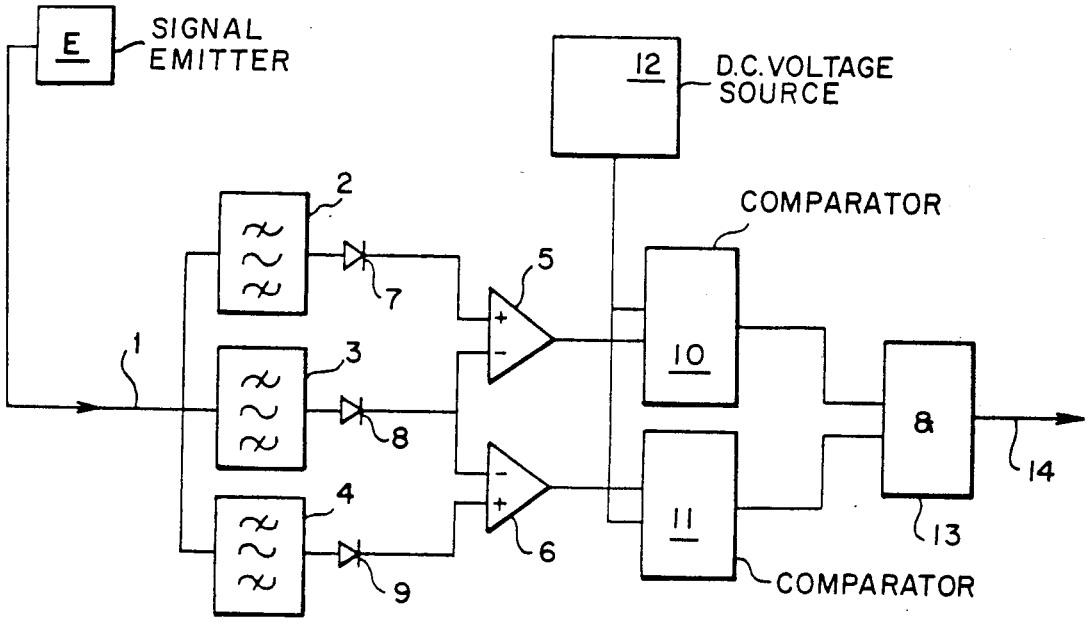
E
SIGNAL EMITTER
12
D.C. VOLTAGE SOURCE
COMPARATOR
2
3
4
5
6
7
8
9
1
10
11
8
13
14
COMPARATOR

METHOD AND APPARATUS FOR DETERMINATION OF THE STATE OF AN ALL-OR-NONE MODULATED ALTERNATING SIGNAL IN A PERTURBED ENVIRONMENT

The present invention relates to a process and apparatus for determination, on reception, of the state of an all-or-none modulated alternating signal circulating in a perturbed environment.

In a general way, the determination of the state of such a signal is obtained by comparison of the amplitude of the signal with a reference level previously determined. The state of the signal is thus given by the sign of the difference. In a perturbed environment, however, there is a risk of falsely interpreting the state of the signal, as, for example, in the presence of a permanent or temporary weakening of the signal due to the environment in the band of emitted frequency. When such weakenings occur randomly, it is not possible to determine an optimal reference level.

The present invention has as its objective the alleviation of these drawbacks by a novel method and apparatus for carrying out the same utilizing a reference signal dependent on the environment in the same way as is the signal the state of which is to be determined.

A further object of the invention is to provide a new and improved modulation state determination method and apparatus of more general use, as well.

Other and further objects of the invention will be apparent from the ensuing discussion.

In summary, according to the invention, the amplitude of a useful all-or-none modulated alternating signal, the state of which one desires to determine, is compared, on reception to that of at least one non-modulated reference signal, emitted with a frequency in the neighborhood of that of the useful alternating signal, and with the same amplitude as the latter, and subjected to the same perturbed environment. The value of the difference of the amplitudes of these signals on reception thus, with respect to a previously determined value, enables determination with certainty of the state of the useful signal.

Preferably, in order to obtain greater reliability of the result, the useful alternating signal, the state of which one desires to determine, is bracketed by two simultaneously emitted reference signals, having frequencies respectively slightly greater and slightly less than that of the useful signal. Preferred techniques and apparatus and best mode embodiment are hereinafter presented.

Such a process can be particularly useful in a system of on-time transmission of information as in railroading, with the involvement of fixed rail-line contacts.

These systems generally are constituted by an apparatus aboard the train, and comprise, on the one hand, an emitter, which continously emits over two conducting wires a number of signals of different frequencies, and on the other hand, a detector of these signals, connected to two conducting wires. One of these two wires is connected to a rail section through the intermediary of at least one wheel of the train, while the other wire is connected to a brush contact.

On the ground, locally, each automatic stop is connected to the rail section through the intermediary of a resonant circuit, in such a way that the latter circuit shunts the detector when the brush contact comes into contact with the automatic stop. Consequently, at the time the train passes the automatic stop, the detector no longer detects the signal the frequency of which corresponds to that of the resonant circuit (i.e., the useful signal). The absence (or at least weakened) state of the useful signal at the detector is determined so that the operator is informed of corresponding information in timely fashion.

When applied in a system of the foregoing type, for example, the invention ensures that the operator receives only accurate information. In particular, the invention avoids false determinations of changes in the useful signal state by discriminating between absences (or weakenings) caused by the resonant circuit and those caused by a perturbed signal environment. Preferably, as noted earlier, the useful signal is bracketed by two non-modulated reference signals emitted simultaneously therewith. The reference signals have the same amplitude as the useful signal and frequencies respectively slightly above and slightly below that of the useful signal. The signals are preferably received by a circuit comprising three selective filters arranged in parallel and turned respectively to the three frequencies employed. To the output of these filters are connected two operational amplifiers respectively through the intermediary of a diode rectifier, in order to generate the difference in amplitude between each of the reference signals and the useful signal. The outputs of the operational amplifiers are, in turn, connected respectively to the inputs of two comparators, the other inputs of the comparators having applied thereto a constant voltage determining a difference threshold. The inputs of an AND gate are connected respectively to the output terminals of the two comparators, the output state of the AND gate being representative of the state of the useful signal.

The invention will be better understood, and other goals, advantages and characteristics will become more clear with reference to the following description and to the appended drawing, the single FIGURE of which represents schematically preferred apparatus for carrying out the method of the invention.

As indicated previously, the method of determination of the state of a useful all-or-none modulated alternating signal in a perturbed environment is based on the utilization of a reference in the same perturbed environment, that depends on the environment in the same way as the useful signal, with respect to its amplitude. This reference is obtained by means of at least one non-modulated alternating reference signal, emitted simultaneously with the useful signal, having a frequency in the neighborhood of that of the useful signal, and the same amplitude of origination.

Preferably, as also before stated, two alternating signals are used, having frequencies respectively slightly higher and slightly lower than that of the useful signal.

On reception, after separation of the different signals by filtering, the amplitude of the useful signal is compared to the amplitude of the reference signal or signals, these signals being expected to suffer at the same time the same attenuations in the perturbed environment, their frequencies being so close to one another.

It thus suffices to determine a threshold for the difference obtained in this way, in order to determine the state of the useful signal, and in order to eliminate the effects of slight fluctuations of reception levels.

One preferred mode of realization of apparatus for carrying out this process is represented schematically in the single FIGURE, in the case of a useful signal bracketed by two reference signals. The signals are emitted, by a signal emitter E, over the line 1 which traverses a perturbed environment. Three selective filters 2, 3, 4 are arranged in parallel in order to effect the separation of the signals. The pass-band filters 2 and 4 are designed to isolate the reference signals bracketing the useful signal isolated by the pass-band filter 3.

The output terminals of these filters are connected to the input terminals of two operational amplifiers 5, 6 through the intermediary of diode rectifiers 7, 8, 9. The filters 2 and 4, corresponding to the reference signals, are connected respectively to the positive terminal of the amplifier 5, 6 while the filter 3 is connected to the negative terminal of each of these two amplifiers. The amplifiers thus generate difference signals at their respective outputs which are proportional to the difference in amplitudes between the respective reference signals and the useful signal.

These difference signals are applied respectively to comparators 10, 11, each of which has a pair of inputs. In the form shown, the output of amplifier 5 is connected to one of the inputs of comparator 10, while the output of amplifier 6 is connected to one of the inputs of comparator 11. The remaining comparator inputs are connected to a direct current voltage source 12 which provides a signal at the threshold adopted for the reference value.

The output of each of the comparators 10, 11 is connected to a respective one of the two inputs of an AND gate 13, at the output 14 of which is formed a signal respresentative of the state of the useful signal. It will be appreciated that comparators 10 and 11 deliver a signal at their respective output terminals only if the amplitude of the signal representative of the difference coming from the corresponding amplifiers 5 and 6 is greater than the determined threshold, and that the AND gate delivers a signal at its output 14 only if the two comarators 10, 11 deliver a signal at the same time.

Consequently, a signal appears at the output 14 only if the useful signal on the line 1 is very much diminished with respect to the two reference signals which bracket it; that is, when the attenuation of the useful signal is not due to a perturbation which originates from the environment of the line 1, but rather to the modulation of the useful signal to its "none" state. More particularly, when the useful signal is diminished by a perturbation in the environment of line 1, at least one of the reference signals will likewise be diminished due to the close resemblance of the reference signals to the useful signal as previously described. At least one of the difference signals from amplifiers 5, 6 will, in such case, be insufficient to exceed the adopted threshold reference value and the corresponding comparator will not be triggered. When, on the other hand, the useful signal is modulated to its "none" state, the output of filter 3 will be very small relative to those of filters 2 and 4. In this event, amplifiers 5, 6 will generate substantial difference signals so that the threshold reference value is exceeded and comparators 10, 11 will deliver output signals to the inputs of AND gate 14.

Such a process and such an apparatus find application in the railroading sphere for the timely transmission of information between the ground and a train.

Although preferred forms of the method and apparatus according to the invention have herein been described, in a non-limitational way, it is obvious that various changes and modifications by those skilled in the art may be made within the spirit and scope of the present invention as defined in the appended claims. In particular, the method and apparartus of the invention can easily by generalized in various forms; for example, if it is desired to determine the state of n useful signals, n being a whole number, it is possible to use n+1 reference signals, each useful signal falling between two reference signals, in order to economize in the number of reference signals and associated components.

What is claimed is:

1. A method of determining, on reception, the state of a useful signal emitted at a predetermined frequency and initial amplitude and subjected to a perturbed environment, said signal being all-or-none modulated, comprising emitting into said environment simultaneously with the emission of said useful signal a non-modulated reference signal of the same initial amplitude at a neighboring frequency, receiving said useful and reference signals, continuously generating a difference signal of the amplitude proportional to the difference between the amplitudes of the received useful and reference signals, and comparing the amplitude of said difference signal to a reference value to indicate whether said useful signal is in an all state or in a none state.

2. A method in accordance with the claim 1, further comprising emitting into said environment simultaneously with the emission of said reference signal an additional non-modulated reference signal of the same initial amplitude and another neighboring frequency selected so that the neighboring frequencies of the respective reference signals are higher and lower than that of said useful signal, receiving said additional reference signal, continuously generating an additional difference signal of amplitude proportional to the difference between the amplitude of the useful and additional reference signals, comparing the amplitude of said additional difference signal with said reference value and determining when the respective amplitudes of said difference signal and said additional difference signal both exceed said reference value to indicate whether said useful signal is in an all state or in a none state.

3. Apparatus for detecting, on reception, the state of a useful signal emitted at a predetermined frequency and initial amplitude and subjected to a perturbed environment, said signal being all-or-none modulated, comprising means for emitting into said environment simultaneously with the emission of said useful signal a non-modulated reference signal of the same initial amplitude at a neighboring frequency, and means for receiving said signals, said receiving means including a first pass-band filter tuned to the frequency of said useful signal, a first rectifier having an input connected to the output of said first filter, a second pass-band filter tuned to the frequency of said reference signal, a second rectifier having an input connected to the output of said second filter, an operational amplifier having positive and negative input terminals each connected to a respective one of the outputs of said first and second rectifiers, a comparator, and a DC voltage source, said comparator havine one input connected to the output of said operational amplifier and another input connected to the output of said DC voltage source and having an output for indicating whether said useful signal is in an all state or in a none state.

4. Apparatus in accordance with claim 3, wherein said emitting means includes means for emitting into said environment simultaneously with said reference signal an additional non-modulated reference signal of the same initial amplitude at a neighboring frequency selected so that the neighboring frequencies of the respective reference signals are higher and lower than that of said useful signal and wherein said receiving means is adapted to receive said additional reference signal, said receiving means further including a third pass-band filter tuned to the frequency of said additional reference signal, a third rectifier having an input connected to the output of said third filter, an additional operational amplifer having positive and negative input terminals each connected to a respective one of the outputs of said first and third rectifiers, the output of said first rectifier being connected to both of said operational amplifiers with the same polarity, an additional comparator and an AND gate, said additional comparator having one input connected to the output of said additional operational amplifier and another input connected to the output of said DC voltage source, said AND gate having a pair of inputs each connected to a respective one of the outputs of said comparators and having an output for indicating whether said useful signal is in an all state or in a none state.

* * * * *